United States Patent [19]

Spengler

[11] 4,041,847

[45] Aug. 16, 1977

[54] APPARATUS FOR SEPARATING PUNCHED-OUT WORKPIECES FROM THE SURROUNDING WASTE MATERIAL

[75] Inventor: Ernst M. Spengler, Heusenstamm, Germany

[73] Assignee: Stanztechnik GmbH Roeder & Spengler, Bergen-Enkleim, Germany

[21] Appl. No.: 586,896

[22] Filed: June 16, 1975

[30] Foreign Application Priority Data

June 21, 1974 Germany ..... 2429903
Jan. 23, 1975 Germany ..... 2502543

[51] Int. Cl.[2] ..... B26D 7/18

[52] U.S. Cl. ..... 93/36 A; 83/103; 83/561; 225/103

[58] Field of Search ..... 225/2, 93, 94, 96, 96.5, 225/103, 104; 83/368, 248, 561–564, 525, 527, 530, 461, 103, 125; 408/13–14; 144/193 R, 193 A, 194; 93/36 A

[56] References Cited

U.S. PATENT DOCUMENTS

| | | | |
|---|---|---|---|
| 1,622,401 | 3/1927 | Sifkovitz | 83/125 |
| 2,413,999 | 1/1947 | Shaner | 83/103 |
| 2,572,537 | 10/1951 | Taylor | 93/36 A |
| 2,845,011 | 7/1958 | Schilling | 93/36 A |
| 3,055,275 | 9/1962 | Schroter | 93/36 A |
| 3,507,179 | 4/1970 | Sauer et al. | 83/564 |
| 3,570,734 | 3/1971 | Allen | 225/96.5 X |
| 3,767,313 | 10/1973 | Bohoroquez | 408/14 |
| 3,786,731 | 1/1974 | Bobst et al. | 93/36 A |
| 3,788,179 | 1/1974 | Vallier | 83/562 X |
| 3,834,436 | 9/1974 | Burkett | 144/193 A X |

*Primary Examiner*—Frank T. Yost
*Attorney, Agent, or Firm*—W. G. Fasse; W. W. Roberts

[57] ABSTRACT

The present apparatus is constructed for separating previously punched out workpieces from the surrounding waste material, for example, punched-out carton shapes. Preferably, the workpieces are arranged in a stack supported on a worktable. Power driven break-out tool means are located for up and down movement, as well as for lateral back and forth movement above the worktable. If desired, power driven push out means are arranged below the worktable with a push rail extending through a respective channel in the worktable. The break-out tool means and the push rail are arranged to be effective on a stack of workpieces on opposite sides and at opposite ends. The break-out tool and/or the push rail apply a levering action to the workpieces to break any lands or bridges which prior to such levering action connect the workpiece proper to the surrounding waste material.

17 Claims, 10 Drawing Figures

1

34
4
41
41
3
7
5
4
40
3'
3'
40
28
8
6
39
10
32
42
2
51
51
52
48
49
48
55
44
45

APPARATUS FOR SEPARATING PUNCHED-OUT WORKPIECES FROM THE SURROUNDING WASTE MATERIAL

BACKGROUND OF THE INVENTION

The present invention relates to an apparatus for separating punched-out workpieces from the surrounding waste material. When punching predetermined shapes for example, to make cartons or the like out of flat material, it is customary not to sever the workpiece shape completely along the entire length of the cut line, but rather to leave lands or bridges at a few locations in order to retain the punched-out workpieces within the plane of the original flat material so that the workpieces may be arranged in a stack. The stacking is usually accomplished in a fully automatic manner. When the stack reaches a predetermined height, the stacked, punched-out material is handled in entire packets to break out the workpieces to separate them from the surrounding waste material. This operation is manually done by means of rubber hammers, air pressure hammers, or milling tools. In spite of the use of these auxiliary means, the severing of the punched-out pieces from the surrounding waste material is rather cumbersome and requires the exertion of a substantial force. Besides, it is time consuming.

OBJECTS OF THE INVENTION

In view of the above, it is the aim of the invention to achieve the following objects singly or in combination:

- to avoid the drawbacks of the prior art specifically with the aid of an apparatus capable of separating the punched-out shapes in a simple and easy manner from each other and from the surrounding waste material;
- to construct the apparatus in such a manner that the operator is merely required to locate a break-out tool into the proper operating position, while the actual severing is done automatically;
- to construct the severing apparatus in such a manner that even after the separation of a whole stack of punched-out workpieces from the surrounding waste material, the workpieces will still be retained in stack formation;
- to provide means for sensing the height of a stack in order to control the work stroke of a wedging tool in accordance with such stack height;
- to arrange a break-out or wedging tool and, if desired, a counter-push up rail in such a manner that the coaction of the two tools applies a lever action to the stack of workpieces; and
- to provide the break-out or wedging tool with such a shape that it will also apply a lever action as it penetrates into the cut line between the workpieces proper and the surrounding waste material.

SUMMARY OF THE INVENTION

According to the invention the present apparatus comprises a frame in which a break-out or wedging tool is supported for horizontal back and forth adjustment and for power driven vertical up and down movement. Hereafter the terms "break-out tool" or "wedging tool" will be used interchangeably. The wedging tool has a free end tip forming a blade. The wedging tool has such a shape that it applies along with the wedging action a leverage action for tearing or severing any lands which still connect the workpieces proper with the surrounding waste material. If desired, there is also provided a push-out rail which becomes effective from below a working table. The wedging tool and the push out rail are arranged to become effective on opposite sides and at opposite ends of the stack of workpieces so as to apply a double lever action when the two tools are effective simultaneously, if desired.

The wedging tool is adjustable by the operator above a stack of workpieces by means of a guide apparatus in such a manner that the wedging tool may enter into the cut lines of a plurality of individual sheets or panels of a stack of workpieces, whereby these cut lines are precisely in register with each other. The driving of the wedging tool into the stack of workpieces is accomplished by means of a power drive, preferably a pneumatic motor. Thus, the operator merely has to properly locate the wedging tool while the actual wedging of the punched-out material is accomplished automatically, whereby the lands or ridges, which still interconnect the punched-out workpieces with the surrounding waste material are torn or severed and the workpieces are freed from the surrounding waste material in complete stacks or packets simultaneously.

BRIEF FIGURE DESCRIPTION

In order that the invention may be more clearly understood, it will now be described, by way of example, with reference to the accompanying drawings, wherein.

DETAILED DESCRIPTION OF EXAMPLE EMBODIMENTS

Figure 1:
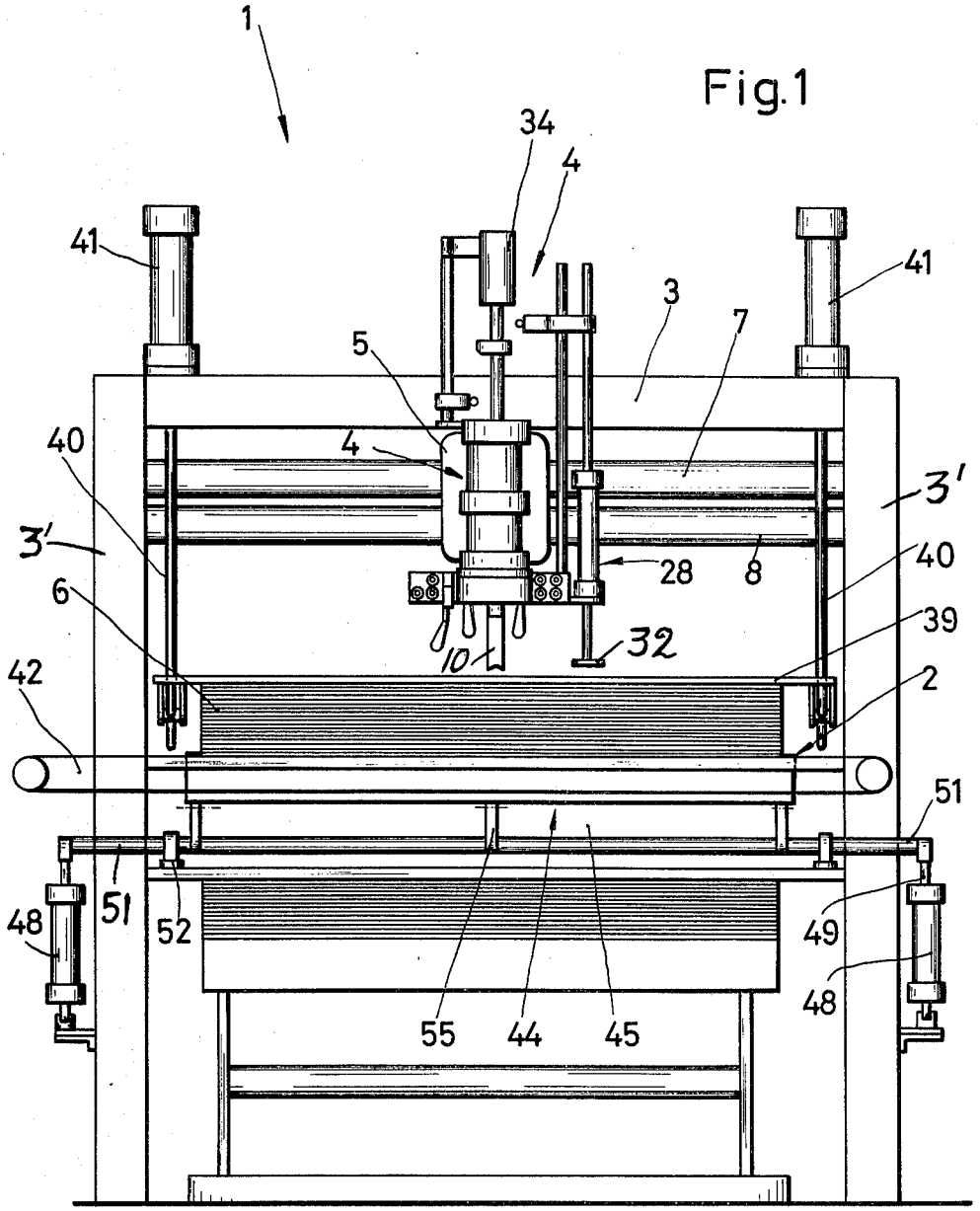
FIG. 1 is a front elevational view of the apparatus according to the invention.
Figure 2:
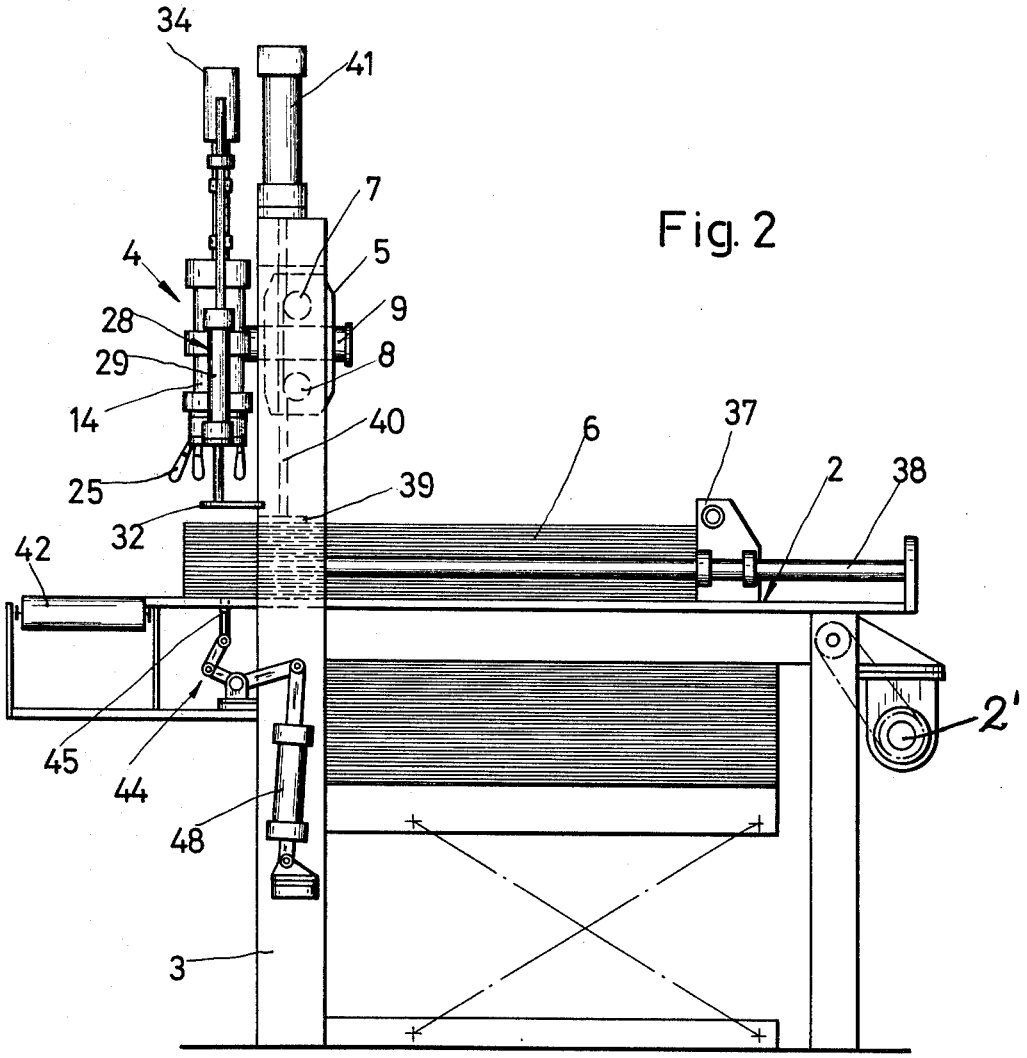
FIG. 2 illustrates a side view of the present apparatus.
Figure 3:
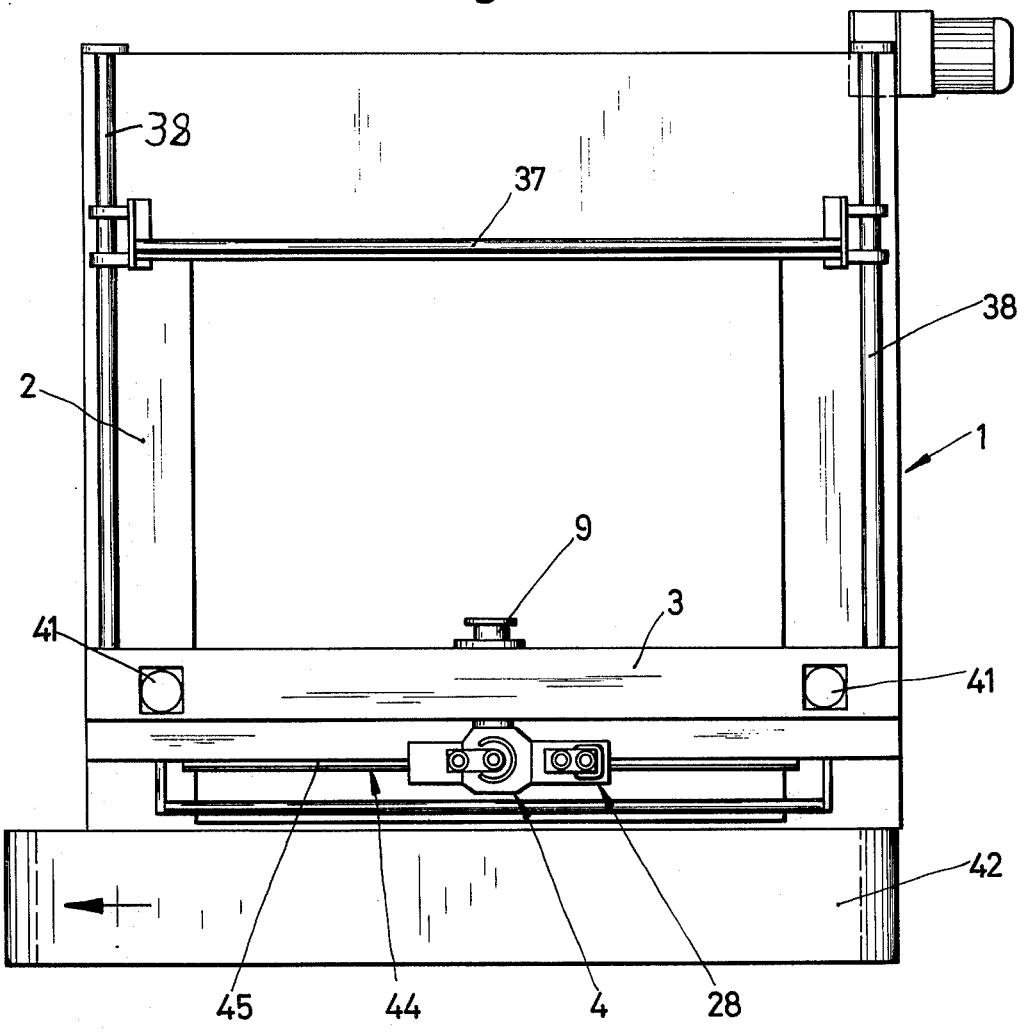
FIG. 3 is a top plan view of the apparatus shown in FIG. 1 and in FIG. 2.

As shown in FIGS. 1 and 2, the present apparatus 1 for severing punched-out workpieces from a stack or from the waste material surrounding the workpieces, comprises a stacking or worktable 2 providing a horizontal support for the stacked-up workpieces. Upright columns 3' interconnected at the upper end thereof by a cross bar 3 form a frame structure for supporting a wedging tool mechanism 4. The wedging tool mechanism 4 includes a carriage 5 slidably supported on horizontal guide rods 7 and 8, whereby the carriage 5 is movable back and forth across the entire width of the stacking table 2. Further, a stack 6 on the stacking table 2 may be shifted along the surface of the stacking table 2 in a direction extending perpendicularly to the direction of movement of the carriage 5. Thus, the wedging tool may be located at any desired point on a stack.

The wedging mechanism 4 is supported by an adjustment or guide device 9 which permits, as viewed in FIG. 2, an adjustment of the wedging mechanism 4 to the right and left, that is in the plane of the drawing of FIG. 2. This adjustment may, for example, be accomplished by means of a threaded nut and screw arrangement forming the guide device 9. The wedging mechanism 4 is also adjustable in a direction extending perpendicularly to the plane of the drawing of FIG. 2. For this purpose the guide device 9 is supported in a carriage 5 which is movable along guide rods 7 and 8. With the just described two movements the wedging mechanism 4 may be precisely positioned relative to the workpieces. The guide device may also comprise a piston cylinder arrangement, whereby means are provided which would prevent the relative rotation between the piston and cylinder. Such means could, for example, comprise two piston cylinder arrangements with the pistons interconnected.

The wedging apparatus 4 comprises wedging tool means 10 having a free end 11 shaped as a wedge with a cutting edge 12 at its free end tip. The details of the shape of one embodiment of the wedging tool 10 will be described in more detail below, especially with reference to FIG. 6.

The wedging tool 10 is power driven, preferably by a pneumatic air pressure motor 13 having a cylinder 14 which, for example, is secured to the guide member 9 by means of a holding ring or sleeve 15. For example, and as an alternative, the ring 15 may be secured to a guide rod which is slidable back and forth in tubular guide member 9, whereby set screws or the like may be used to secure the cylinder 14 relative to the guide member 9 in an adjusted position. The wedging tool 10 may form part of the lower end of a piston rod driven by the pneumatic motor 13 or the wedging tool 10 may be attached to the piston rod by conventional means. A further piston rod 16 driven by the motor 13 extends out of the upper end of the cylinder 14. The upwardly extending piston rod 16 has a substantial length and carries at a predetermined position along its length a trip dog 17 which cooperates with a lower limit switch 18 adjustably secured to a carrier rod 19, which in turn is supported by the cylinder 14. A further limit switch 20 is attached to the upper end of the carrier rod 19. The two limit switches 18 and 20 are adjustable in their position vertically up and down along the length of the carrier rod 19 so that these limit switches 18 and 20 may be placed at different elevational positions. Means for such an adjustment are well known in the art. By this arrangement it is possible to control the length of the stroke of the wedging tool to adapt it to the height of a workpiece stack, as will be described in more detail below.

Figure 4:
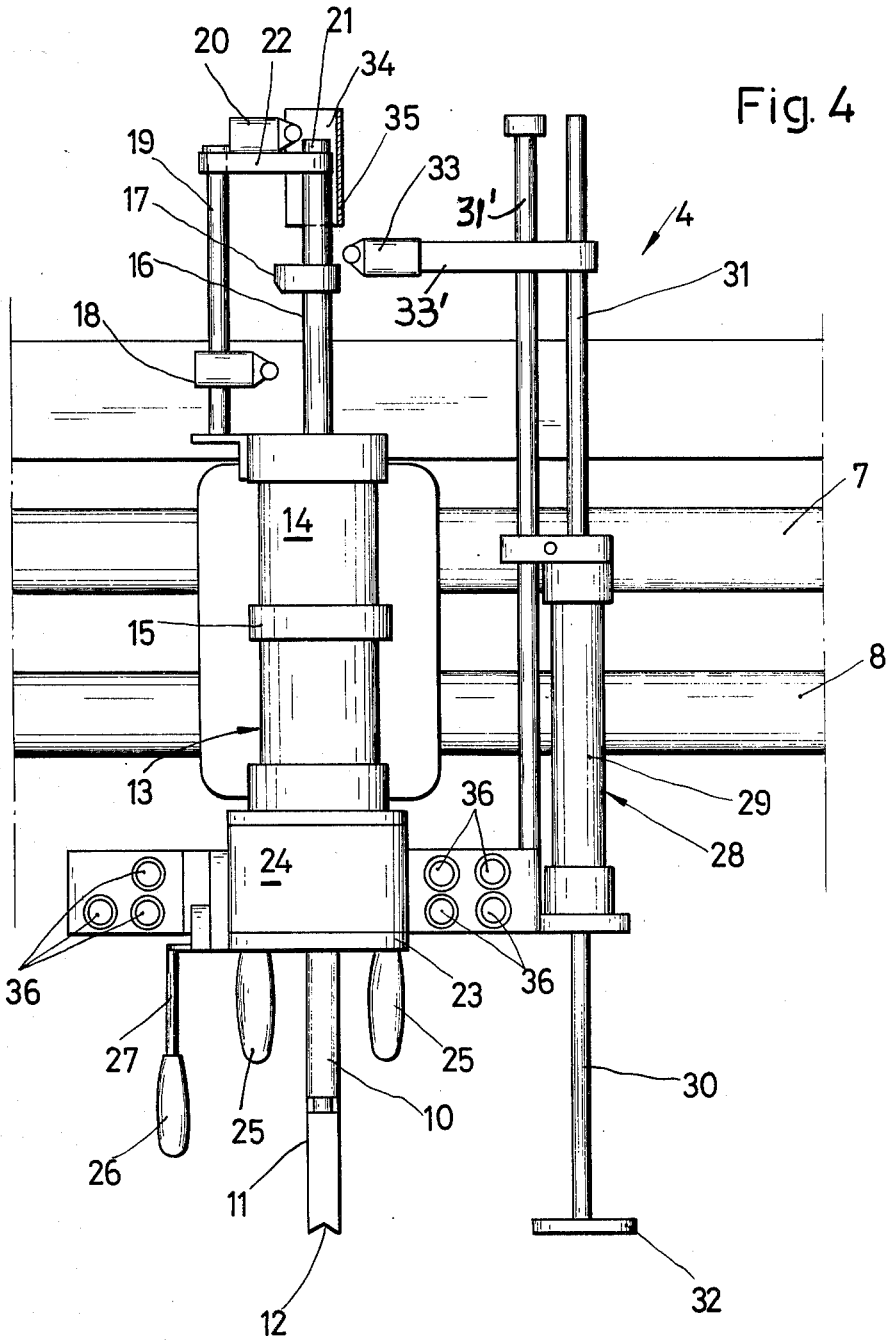
FIG. 4 shows on a somewhat enlarged scale the details of the support carriage and drive means for the wedging tool.

As especially illustrated in FIG. 4, the upper limit switch 20 cooperates directly with the free end 21 of the piston rod 16. Thus, when the limit switch 20 is contacted by the free end 21 a control impulse is produced, for example, by closing a respective electric or pneumatic circuit. Such circuits are well known in the art. Preferably, the limit switch 20 is supported on a spacer and guide plate 22 which is rigidly secured on the one hand to the carrier rod 19 and which slidingly surrounds at least partially with its other end the rod 16.

The wedging tool 10 is movable up and down by admitting pressure medium into the cylinder 14 either above the piston or below the piston. The respective pressure supply lines are not shown for simplicity's sake. In addition, the wedging tool 10 may be rotated about its longitudinal axis. In order to enable such rotation of the wedging tool 10, there is provided a bearing housing 24, the downwardly facing side of which is closed by a plate 23. Several handles 25 are secured to said plate 23, whereby the operator may directly rotate the wedging tool 10 by hand.

Adjacent to the handle 25, there is also arranged a further handle 26 secured to an arm 27 by means of which the entire wedging device 4 may be moved back and forth in the direction of the guide member 9. Preferably, the handle 26 with its arm 27 form part of a transmission linkage connected to the above mentioned piston cylinder means which may form the guide device 9 and by means of which exact movements of the wedging apparatus 4 in the forward and backward direction may be accomplished. Such transmission linkage means are well known in the art and hence not shown in detail in FIG. 4.

An essential feature of the wedging apparatus 4 comprises a staple height sensing device 28 to ascertain the height of the staple 6 of workpieces for moving the wedging tool 10 into a starting position. The device 28 comprises a cylinder 29 arranged in parallel to the motor cylinder 14. The two cylinders 14 and 29 are rigidly interconnected with each other. A piston is arranged in the cylinder 29 for pressure application on one or the other side. The respective pressure supply lines, which would be connected to the top and bottom end of the cylinder 29 are also not shown for simplicity's sake. A first piston rod 30 extends downwardly out of the cylinder 29. A second piston rod 31 extends upwardly out of the cylinder 29. A stop or sensing member 32 is secured to the lower end of the downwardly extending piston rod 30, which extends in parallel to and in the same direction as the wedging tool 10. A control sensing member 33, such as a limit switch is secured to the upwardly extending piston rod 31. A guide rod 31' extends in parallel to the piston rod 31 and is rigidly secured to the cylinder 29. Preferably, the control sensing member 33 is supported by a cross bar 33', which slides up and down the guide rod 31'. Thus, the structure comprising the piston rods 30 and 31, the sensing member 32 and the sensing limit switch 33 moves up and down in unison.

The control limit switch 33 cooperates with a stop member 34 secured to the upper end of the rod 16 extending out of the air pressure motor 13. Preferably the stop member 34 has the shape of a cylinder which is provided with a slot facing the carrier rod 19 so that the support bar 22, which carries the limit switch 20 may pass through the slot in the cylinder 34. The control limit switch 33 produces a control pulse as soon as it contacts the lower end 35 of the stop member 34. The cylindrical shape of the stop member 34 has the advantage that it assures a fault-free operation of the control limit switch 33 independently of the instantaneous position of the wedging tool 10, since the latter is rotatable. In other words, the stop member 34 will ride up and down with the piston rod 16 and is rotatable together with the support and guiding bar 22 and the carrier rod 19 about the axis of the rod 16.

Adjacent to the handles 25 and 26 there are arranged switching means 36, such as electric switches or pneumatic control means. The respective control circuits are not shown, since they are not part of the invention.

In operation, when a stack 6 of punched-out workpieces has been brought into the position shown in FIG. 2, a clamping bar 39 is lowered onto the stack 6 to precisely fix the position of the stack. The feed advance of the stack 6 may be accomplished by a line-up plate 37 driven by a threaded spindle 38. The spindle 38 may be driven by power drive means 2' only schematically shown in FIG. 2. The line-up plate 37 may also be moved back and forth along its guide rods 38 by any other suitable and well known means, for example, a hydraulic piston cylinder means. The clamping bar 39 is secured to the free ends of piston rods 40 which are movable up and down by respective piston cylinder means 41 carried at the top of the frame structure by the cross bar 3. Here again, the hydraulic or pneumatic pressure supply means for the cylinders 41 are not shown for simplicity's sake.

As soon as the position of a stack 6 has been properly secured by means of the clamping bar 39, the height of the stack 6 is ascertained by means of the sensing device 28. For this purpose the cylinder 29 is supplied with air pressure at its upper end so that the sensing member 32 is lowered until it contacts the surface of the stack, preferably the surface of the clamping bar 39. The control limit or sensing switch 33 shown in FIG. 4 is lowered simultaneously with the sensing member 32. When the sensing member 32 is in its stack contacting position, the cylinder 14 is supplied with air pressure at its upper end in order to lower the wedging tool 10 into its starting position, which is reached as soon as the stop member 34 contacts the control limit switch 33, whereby the further supply of air pressure to the cylinder 14 is stopped, so that the edge 12 of the wedging tool 10 stops immediately above the top surface of the stack 6. Thereafter the sensing member 32 may be lifted to any desired elevation so that the entire wedging apparatus 4 is free for movement in any direction above the stack. Now the wedging apparatus 4 is adjusted in such a manner that the edge 12 is located directly above that cut line at which the next wedging operation is to be performed. Thereafter, the respective switches 36 are operated so that the cylinder 14 receives air pressure to move the wedging tool 10 into the stack 6. The wedging tool 10 may have a special shape at its operational front end 11 as may be seen in FIG. 6. A curved slope 11' rises gradually from the edge 12 to the upper part. The curved slope 11' faces the stack 6. The rear surface of the wedging tool 10 may either be straight or it may preferably have a slight recess 59. The recess 59 facilitates the wedging action. As the wedging tool 10 enters into the cut line between the stack 6 and the surrounding waste material 6' the resulting wedging action tears the bridges or lands which still connected the workpieces with the surrounding waste material. Thus, the entire stack 6 becomes free for removal onto a conveyor 42, which transports the workpieces still in stack formation but without the waste material, away from the apparatus 1.

The downward movement or work stroke of the wedging tool 10 is automatically stopped as soon as the trip dog 17 actuates the limit switch 18 which is in a precisely adjusted position. Thereafter, the raising of the wedging tool 10 may be accomplished either automatically by a respective control of the air pressure valves for the cylinder 14 or the operator may actuate the respective raising button, which may be one of the buttons 36. The raising motion is stopped when the upper end 21 of the rod 16 actuates the upper limit switch 20. Thereafter, the next working sequence may be performed as described above.

Figure 5:
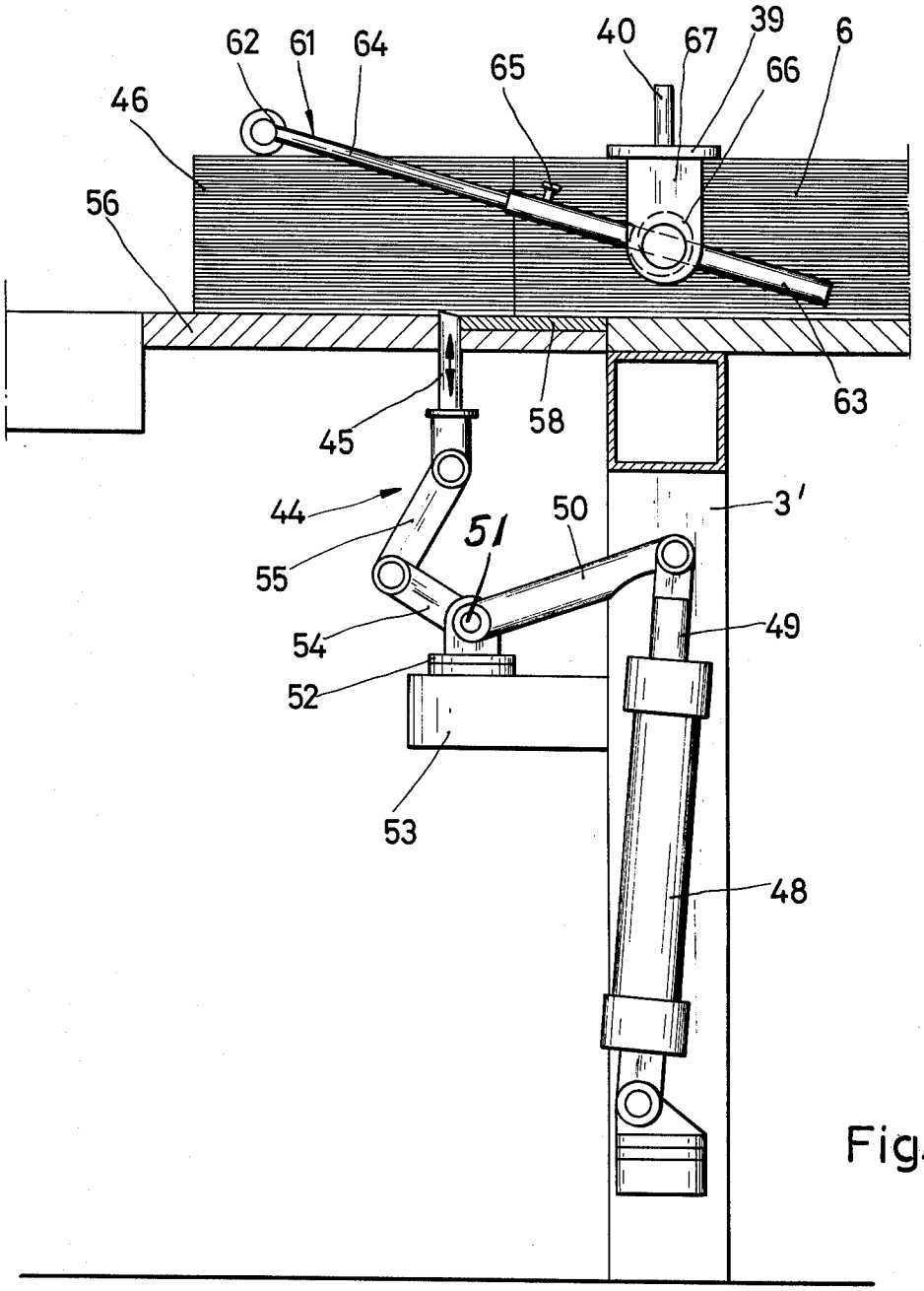
FIG. 5 shows a side view of a power driven lifting mechanism which is provided in addition to the wedging tool and which is arranged below a stack of punched out workpieces.
Figure 6:
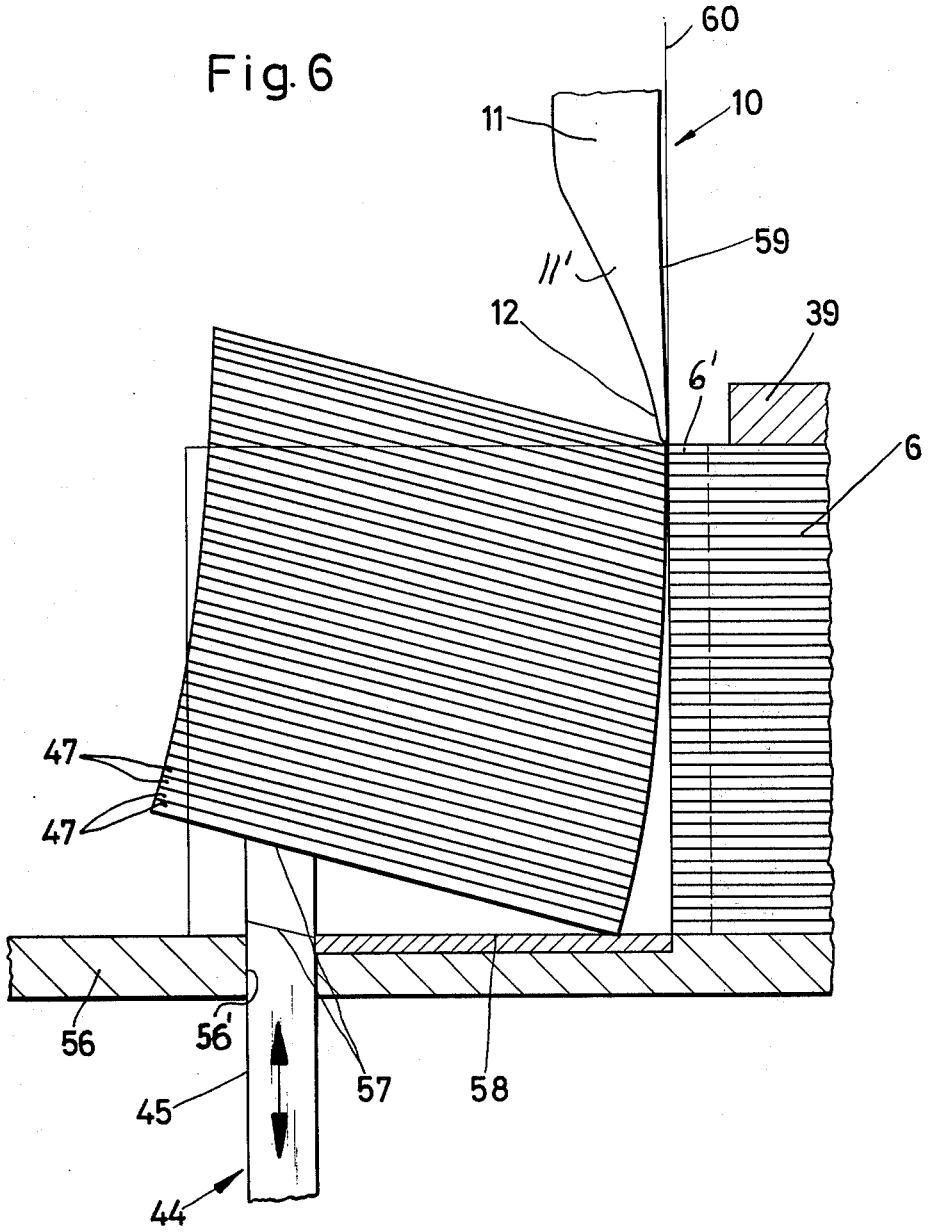
FIG. 6 illustrates a schematic side view of the stack of workpieces with the lifting rail in operation and with the wedging tool in its starting position.

Referring to FIG. 5, the apparatus 1 according to the invention may comprise in addition to the just described wedging apparatus 4 a release and loosening mechanism 44 arranged below the horizontal supporting surface or worktable 56. This mechanism 44 comprises a push rail 45 by means of which the material may be lifted. The push rail 45 extends through a respective channel 56' in the table 56 and substantially across the entire width of the table 56. When the rail 45 contacts the front end 46 of a stack 6 and it is raised, one or several times, a loosening is accomplished especially of the lower workpieces 47 forming the stack as shown in FIG. 6. Depending on the nature of the material of the workpieces the loosening will be more or less effective. The push rail 45 is driven by means of hydraulic cylinders 48, the lower end of which is pivotally connected to the frame columns 3'. The piston rods 49 of the cylinders 48 are pivotally connected to arms 50 which in turn are rigidly secured to a shaft 51, whereby the latter is rotated as the piston rods 49 move up and down, as best seen in FIG. 5. The shaft 51 is supported in the bearing blocks 52, which in turn are secured by brackets 53 to the frame members 3'.

As best seen in FIGS. 1, 2 and 5, the shaft 51 has secured thereto tilting arms 54 in a rigid manner to transmit the back and forth rotation of the shaft 51 to lifting arms 55 which are pivoted to the tilting arms 54 at their lower ends and journaled to the push rail 45 at their upper ends. The push rail 45 is guided in a respective channel or slot in the working table 56. Preferably the upper edge of the push rail 45 is slightly slanted as shown at 57'. An insert 58 of synthetic material, such as nylon may be provided in the top surface of the working table 56. This insert 58 may extend from a position immediately adjacent to the guide channel of the push rail 45 to a position where it is contacted by the blade 12 of the wedging tool 10 when the latter is lowered into a stack, whereby the table surface is not damaged by the blade 12 and the insert 58 may easily be replaced, if necessary.

As mentioned above, the shape of the wedging tool is best illustrated in FIG. 6 showing a preferred embodiment, whereby the blade 12 of the wedging tool should preferably have two sections, which are inwardly inclined to form a roof shape as best seen in FIG. 4.

As illustrated in FIG. 5, a hold down member 61 may be arranged to rest on the stack of workpieces to hold them in position. The hold down member 61 comprises a rod 62 extending over the entire width of the apparatus. The rod 62 is journaled to brackets 67 of the clamping rod 39. For this purpose, the rod 62 is connected to bars 64 at each end thereof. The free ends of these bars 64 are slidable back and forth in tubular members 63 and the relative position of the rods 64 in the tubular members 63 may be fixed by set screws 65. The tubular members 63 are journaled to the brackets 67 and spring means 66 are provided to urge the tubular members 63 and thus the rods 64 in a counter-clockwise direction and thereby the hold-down rod 62 downwardly against the stack of workpieces 46.

Referring now to the embodiments of FIGS. 7 to 10, there are shown details of modified wedging tools, which substantially simplify the work because several wedging tools 71 to 75 are arranged on a support means 70. The plurality of wedging tools 71 to 75 are adjustable in their spacing relative to each other. In addition, the wedging tools are secured to the support means 70 in such a manner that upon loosening the connection at least certain of said tools may be tilted individually or in unison into a substantially horizontal position, or into a substantially vertical position.

The wedging tool support means 70 comprises a cross rod 78 which is supported by the piston rod 76 of the piston cylinder arrangement 14 according to FIG. 4. For this purpose a connecting piece 77 is secured to the lower end of the piston rod 76 by conventional means. The connecting piece 77 is provided with a hole 79 through which the cross rod 78, having preferably a circular cross section, extends. A set screw 80 or the like (FIG. 10) locks the cross rod 78 to the connecting piece 77.

The cross rod 78 may be rotated in the bore 79 of the connecting piece 77 when the set screw or threaded bolt 80 is loosened. Thus, the wedging tools 71, 72 and 74, 75 may be tilted into a horizontal position by rotating the entire support rod 78 through about 90° about its longitudinal axis.

In the preferred embodiment the cross rod 78 comprises a strong integral length of round sectional steel or the like which extends through the connecting piece 77 and the wedging tools are supported along the length of said sectional steel piece at any desired locations. For this purpose the sectional steel cross rod 78 is provided with longitudinal grooves 81 and 82, which receive holding tongues 83, 84 whereby the wedging tools 71, 72 and 74, 75 are locked in their position relative to the cross rod 78 with their respective holding sleeves 85, so that the wedging tools may not be rotated relative to the cross rod 78. The holding tongues 83, 84 extend for this purpose somewhat out of the circumference of the cross rod 78 and reach into respective grooves 86 in the holding sleeve 85. Thus, these holding tongues 83, 84 definitely lock the position of the wedging tools 71, 72, 74, 75 relative to the cross rod 78. However, these wedging tools 71, 72 and 74, 75 are movable in the longitudinal direction of the cross rod 78 so that the spacing between adjacent tools may be adjusted after loosening the respective set screws 87 which extend through respective threaded holes in the sleeves 85 to such an extent that the free end 88 of these screws 87 engages the holding tongues 83 or 84.

Figure 7:
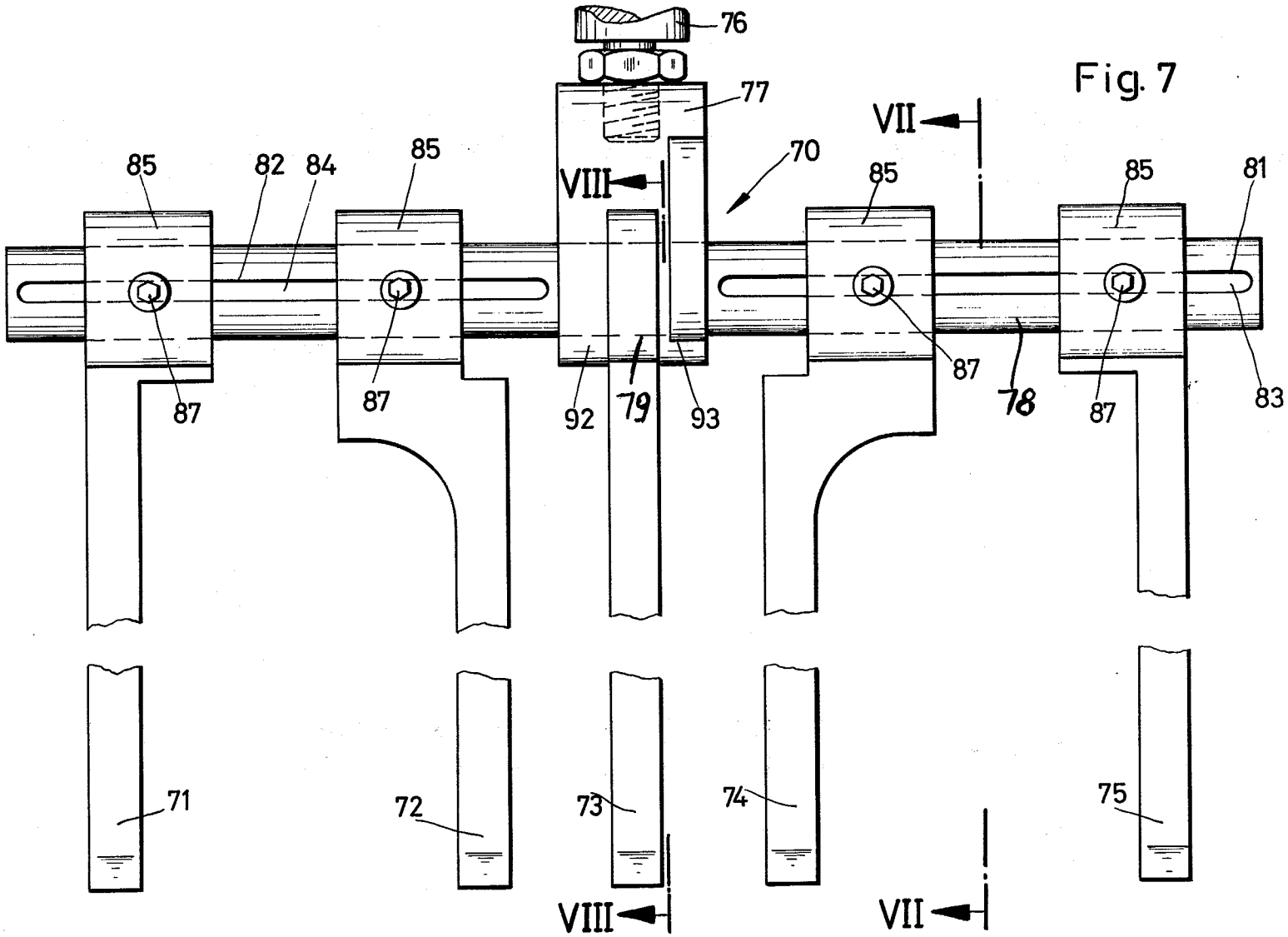
FIG. 7 is a front view of a wedging tool supporting rod having secured thereto for example, five wedging tools.
Figure 8:
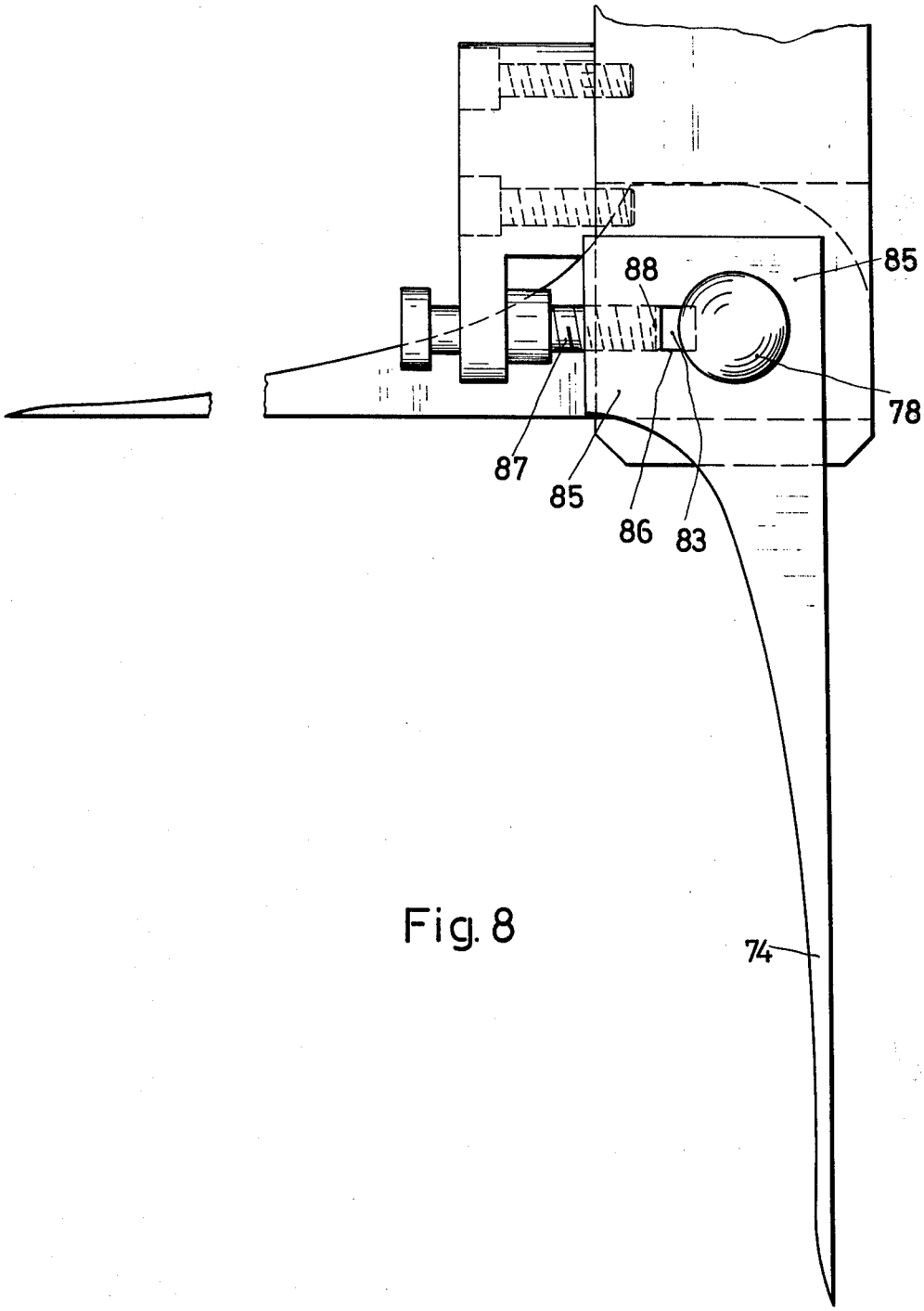
FIG. 8 is a sectional view along the section line VII—VII in FIG. 7 illustrating a side view of the wedging tool on a somewhat enlarged scale.
Figure 9:
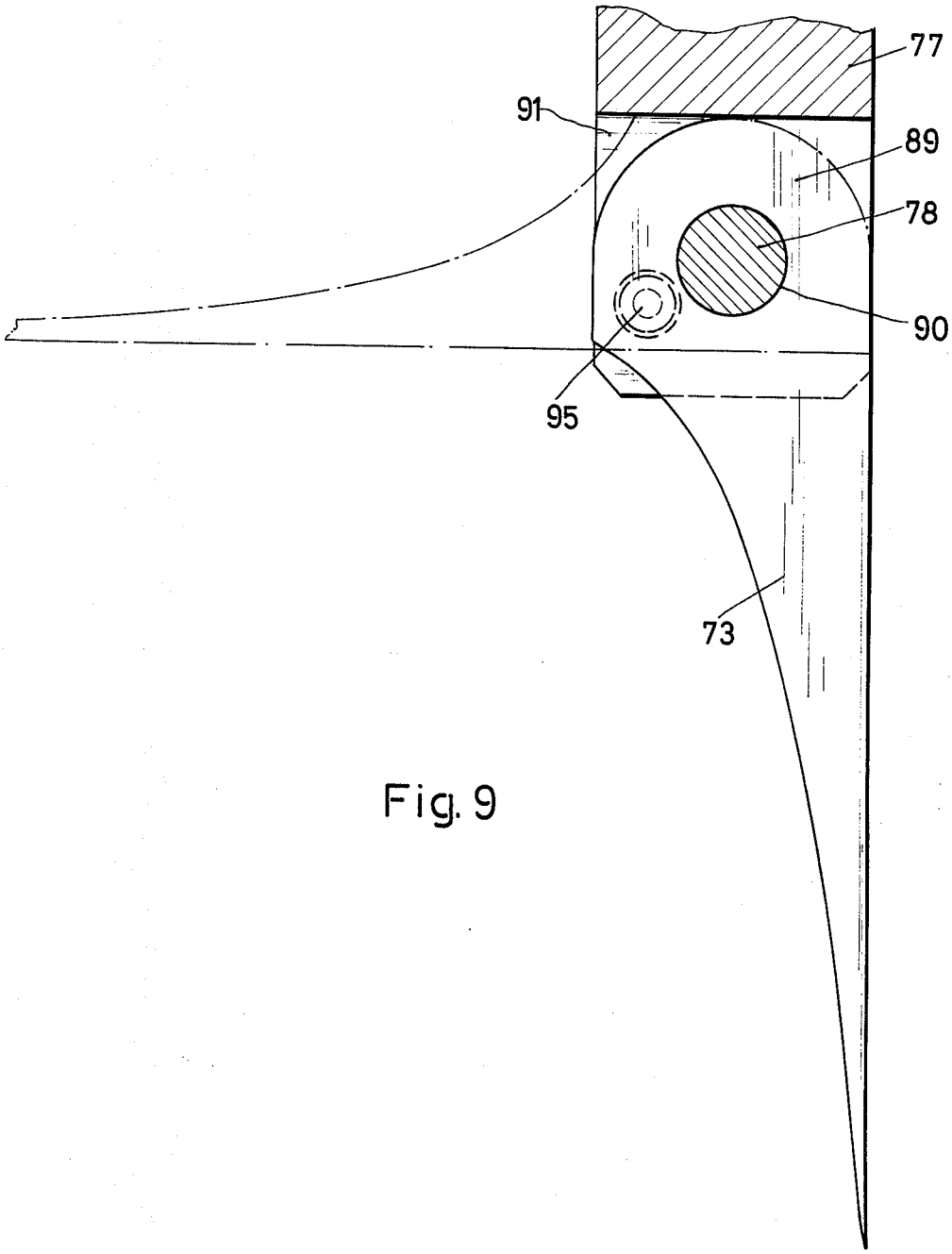
FIG. 9 is a sectional view similar to that of FIG. 8, however, along section line VIII—VIII in FIG. 7.
Figure 10:
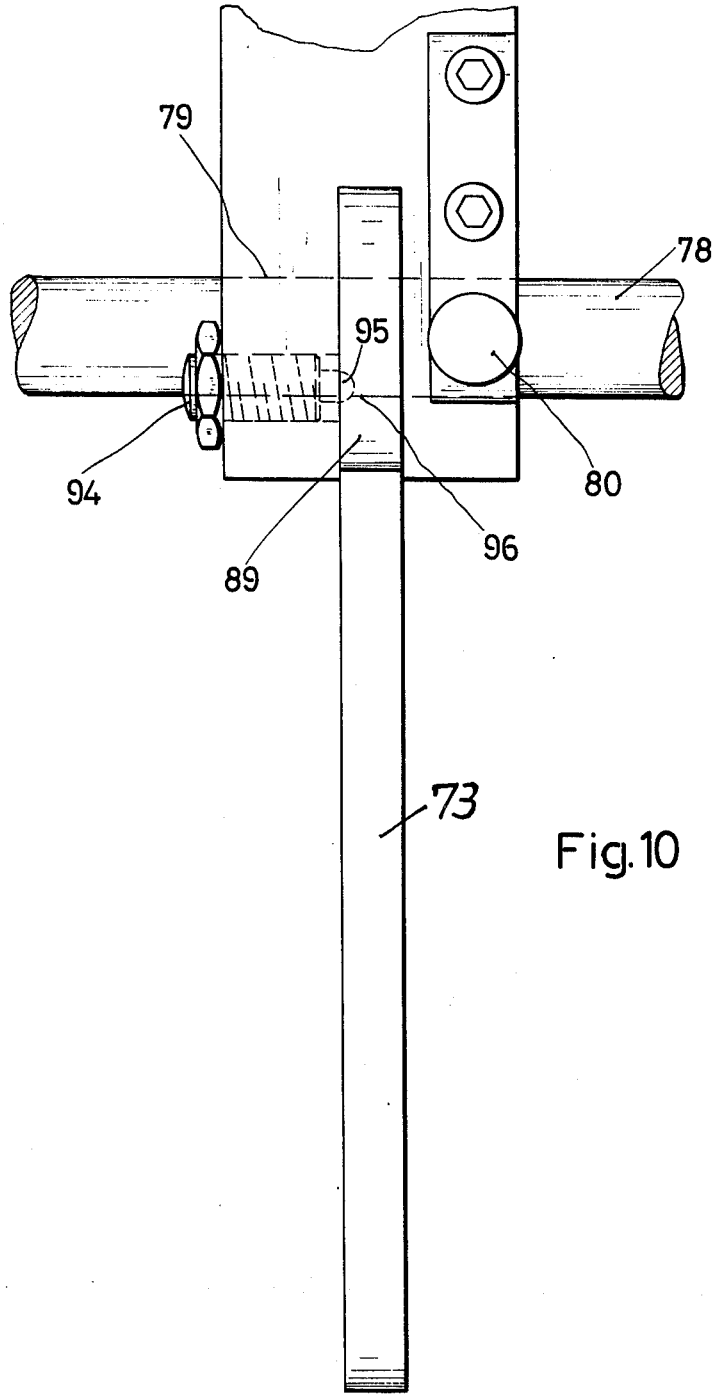
FIG. 10 shows a front view of the centrally located wedging tool and the details of its support means.

The holding piece 77 also supports a wedging tool 73 as best seen in FIG. 9. This particular wedging tool 73 has the advantage that it is directly aligned with the direction of force exerted by the piston rod 76. The wedging tool 73 is also constructed for journaling. However, while the wedging tool 73 may be tilted relative to the cross rod 78, the other wedging tools 71, 72, and 74, 75 are tiltable only together with the cross rod 78 due to the tongues 83, 84. As best seen in FIG. 9, the head end 89 of the wedging tool 73 is provided with a bore 90 through which the cross rod 78 extends. The connecting piece 77 has a recess 91 whereby the lower end of the connecting piece 77 is forked to receive the head end 89 of the tool 73 between two legs 92 and 93 as best seen in FIG. 7.

The wedging tool 73 may be secured in its downwardly extending working position shown in full lines in FIG. 9 as well as in its horizontally extending retracted position shown in dashed-dotted lines in FIG. 9. For this purpose, a locking set screw 94 is rotatable in a respectively threaded hole in the connecting piece 77. The screw 94 has a pin end 95 which engages a respective recess 96 in the head end 89 of the tool 73. Two such recesses 96 are provided for locking the tool 73 in its two positions. When the pin 95 engages a recess 96 a form locking connection is provided between the tool and the holding piece 77.

The invention is not limited to the illustrated example embodiments. Thus, modifications may be made without deviating from the present teaching. The illustrations show that the tools 71, 72 and 74, 75 are tiltable only in unison independently of the center wedging tool 73. However, it is possible to modify the arrangement so that each wedging tool would be tiltable individually. This could, for example, be accomplished by simply removing the tongues 82 and 83 and to make the set screws 87 long enough so that their lower or free ends 88 will engage the grooves 83, 84. Thus, it will be appreciated that it is intended to cover all modifications and equivalents within the scope of the appended claims.

What is claimed is:

1. An apparatus for separating stacked and punched workpieces of flat material from waste material surrounding the workpieces along cut lines interrupted by bridges after a punching operation, comprising a frame structure, horizontal table support means for said stacked and punched workpieces of flat material in said frame structure, guide means secured to said frame structure above said horizontal table support means, said guide means extending across said horizontal table in a given direction, carriage means supported by said guide means for horizontal movement above and across said horizontal table support means in said given direction, tool drive means, adjustment means (9) secured to said carriage means, said tool drive means being connected to said carriage means through said adjustment means which are adjustable in a direction perpendicularly to said given direction, break-out tool means secured to said tool drive means for a controlled vertical up and down movement, said break-out tool means having a free end for controlled movement into said cut lines to break said bridges, whereby movement of said carriage means in said given direction in combination with movement of said adjustment means in the direction perpendicularly to said given direction permits positioning said tool means in unison in a rectangular coordinate system.

2. The apparatus according to claim 1, further comprising sensing means arranged above said horizontal table support means for vertical up and down movement to ascertain the height of a stack of workpieces, trip dog means arranged to move up and down with said tool drive means and cooperating with said sensing means for shifting said break-out tool means into such a starting position that said free end of the break-out tool means is about to touch said stack of workpieces.

3. The apparatus according to claim 2, wherein said tool drive means comprise a pneumatic drive motor for said break-out tool means, said stack height sensing means comprising a pneumatic cylinder, a piston in said cylinder arranged for exposure to a pressure medium on either of its sides, first and second rods secured to a respective one of said piston sides, said rods extending out of said cylinder at each end thereof, a sensing member secured to said first rod at its free, downwardly extending end, said second rod extending upwardly, control means secured to said upwardly extending second rod for cooperation with said trip dog means to bring said wedging tool means into said starting position, limit switch means secured to said tool drive means and vertically spaced from each other, and further trip dog means also arranged for vertical up and down movement with said tool drive means to cooperate with said limit switch means for controlling the length of the stroke of said tool drive means.

4. The apparatus according to claim 2, wherein said stack height sensing means are also secured to said carriage means for horizontal back and forth movement in unison with said tool drive means.

5. The apparatus according to claim 1, further comprising a push out mechanism arranged below said horizontal table support means for loosening said workpieces out of the surrounding waste material.

6. The apparatus according to claim 5, wherein said horizontal table support means comprise a channel extending substantially across said horizontal table support means, said push out mechanism comprising a push rail extending into and through said channel, and drive means operatively connected to said push rail for lifting said workpieces from below, preferably along one edge thereof.

7. The apparatus according to claim 6, wherein said channel is located remote from a line of attack defined by said break-out tool means whereby the upward action of said push rail and the downward action of said break-out tool means cooperate in separating the punched out workpieces from the surrounding waste material.

8. The apparatus according to claim 6, further comprising down holding means arranged above said horizontal table support means, power drive means operatively connected to said down holding means for pressing the down holding means against the workpieces downwardly opposite to the lifting direction of said push rail.

9. The apparatus according to claim 8, wherein said down holding means and said push rail are arranged to be effective at substantially opposite ends of said workpiece, whereby a lever action is achieved by the lifting of the push rail.

10. The apparatus according to claim 1, wherein said break-out tool means comprise a plurality of individual break-out tool members.

11. The apparatus according to claim 10, further comprising a support rod for said break-out tool members, means journaling said support rod to said tool drive means, means for releasably arresting said support rod against journaling movement, and means tiltably securing at least one break-out tool member to said support rod, whereby said one break-out tool member is tiltable from a substantially vertical to a substantially horizontal position independently of the journaling of said support rod.

12. The apparatus according to claim 11, further comprising securing means for adjustably attaching at least certain of said break-out tool members to said support rod for adjusting the spacing between said break-out tool members relative to each other, and locking means arresting said securing means in any adjusted position.

13. The apparatus according to claim 1, wherein said break-out tool means comprise at least one break-out tool member having a curved workpiece facing surface sloping from an upper head end of said break-out tool member to said free end tip.

14. The apparatus according to claim 13, wherein said break-out tool comprises a further surface facing away from said workpiece, said break-out tool member having a relatively shallow recess adjacent to said further surface for facilitating the entry of the break-out tool member into said cut line running between the workpieces proper and the surrounding waste material.

15. The apparatus of claim 1, further comprising workpiece shifting means for shifting a stack of workpieces on said table support means in a direction extending substantially at a right angle relative to said given direction, whereby said horizontal movement of said carriage means in combination with movement of said workpiece shifting means also permits the locating of said break-out tool means substantially in a rectangular coordinate system.

16. An apparatus for separating stacked and punched workpieces of flat material from waste material surrounding the workpieces along cut lines interrupted by bridges after a punching operation, comprising a frame structure, horizontal table support means for stacked and punched workpieces of flat material in said frame structure, guide means secured to said frame structure and extending in a given direction above said horizontal table support means, carriage means supported by said guide means for a horizontal movement in said given direction above said horizontal table support means, tool drive means secured to said carriage means, break-out tool means secured to said tool drive means for vertical up and down movement, said break-out tool means having a free end for movement into said cut lines to break said bridges by a leverage action, said apparatus further comprising adjustment means cooperating in the positioning of said break-out tool means in a direction perpendicularly to said given direction whereby said break-out tool means are positionable in unison in a rectangular coordinate system, a push-out mechanism arranged below said horizontal table support means, a longitudinal slot in said horizontal table support means, and longitudinal pusher bar means movable up and down through said longitudinal slot in said table support means against a stack of punched-out sheet material on said horizontal table support means.

17. The apparatus according to claim 16, wherein said break-out tool means and said pusher means are horizontally displaced relative to each other above and below said horizontal table support means, whereby the cooperation of said break-out tool means and said pusher means applies a levering action on said stacked and punched workpieces.

* * * * *